United States Patent [19]

Sestak

[11] Patent Number: 4,745,526

[45] Date of Patent: May 17, 1988

[54] SPINNING LIGHT

[75] Inventor: Joseph T. Sestak, Erie, Pa.

[73] Assignee: American Sterilizer Company, Erie, Pa.

[21] Appl. No.: 2,586

[22] Filed: Jan. 12, 1987

[51] Int. Cl.[4] ..... F21V 21/30

[52] U.S. Cl. ..... 362/35; 362/250; 362/272; 362/804

[58] Field of Search ..... 362/33, 35, 804, 232, 362/233, 250, 272, 285, 307, 418

[56] References Cited

U.S. PATENT DOCUMENTS

| | | | |
|---|---|---|---|
| 1,960,534 | 5/1934 | Gibney | 362/232 |
| 2,099,975 | 11/1937 | Hackman | 362/35 |
| 2,982,848 | 5/1961 | Rosenberg | 362/35 |
| 2,984,738 | 5/1961 | Belau | 362/232 |
| 4,316,237 | 2/1982 | Yamada et al. | 362/232 |

FOREIGN PATENT DOCUMENTS

| | | | |
|---|---|---|---|
| 1964484 | 7/1971 | Fed. Rep. of Germany | 362/272 |

*Primary Examiner*—Charles J. Myhre
*Assistant Examiner*—David A. Okonsky
*Attorney, Agent, or Firm*—Kirkpatrick & Lockhart

[57] ABSTRACT

A light for providing a larger diameter lighting pattern is comprised of a rotatable support. A motor for rotating the support at a frequency greater than the retention time of the human eye is provided. A source of light which provides a small lighting pattern is carried by the rotatable support such that upon rotation thereof a large diameter lighting pattern is created.

7 Claims, 3 Drawing Sheets

SPINNING LIGHT

BACKGROUND OF THE INVENTION

Field of the Invention

The present invention is directed generally to lighting apparatus and more particularly to surgical lighting.

In many applications, such as surgical applications, the elimination of shadows is highly desirable. Generally speaking, shadow reduction is a function of light source diameter. The larger the diameter, the greater the shadow reduction. However, as light source diameters become larger, it becomes more and more difficult to provide the necessary illumination from a single light head. Thus, as the diameter of light sources increases, multiple light heads are often used.

In U.S. application Ser. No. 754,704 now U.S. Pat. No. 4,651,257, which was filed July 15, 1985, in the name of Gehly and assigned to the same assignee as the present invention, a multiple source lighting fixture is disclosed. The lighting fixture disclosed therein has a plurality of light heads arranged circumferentially around an axis of symmetry of the lighting fixture. Each of the light heads has an associated source reflector. The light heads and source reflectors are oriented such that substantially all of the light is received by a second reflector positioned beneath the plurality of source reflectors. The second reflector receives the light from each of the individual sources and mixes it together in order to eliminate shadows. A third reflector is radially spaced and partially circumscribes the source reflectors. The third reflector receives the light from the second reflector such that a uniform beam of light is projected from the lighting fixture.

Although such lighting fixtures provide a uniform, large diameter, source of light, it is costly to accurately manufacture the numerous reflectors required. Additionally, the reflectors must be accurately positioned in order for the light fixture to properly operate. The numerous reflectors add to the overall cost and weight of the light fixture. Heavier light fixtures require stronger supports again leading to additional costs. Thus, the need exists for a large diameter source of light which eliminates the use of reflectors.

SUMMARY OF THE INVENTION

The present invention is directed to a light for providing a large diameter lighting pattern from a source of light which itself provides a small lighting pattern. The light of the present invention is comprised of a rotatable support. A motor is provided for rotating the support at a frequency greater than the retention time of the human eye. A source of light which provides a small lighting pattern is carried by the support such that upon rotation of the support a large diameter lighting pattern is created.

According to one embodiment of the present invention, the rotatable support includes a rotatable arm. Two light sources, each having small lighting patterns, are positioned on opposite ends of the rotatable arm. The light sources are carried by the arm at an angle such that their respective small lighting patterns intersect.

According to another aspect of the present invention, the rotatable support includes a rotatable arm having a reflective surface. Two light sources, each having a small lighting pattern, are positioned on opposite ends of the arm. The angle between the light sources and the arm permits light from the light sources to be reflected off the reflective surface of the arm.

The light of the present invention substantially eliminates the need for reflectors. The elimination of the reflectors, which must be precisely manufactured, allows the light of the present invention to weigh less and cost less than lights which rely upon multiple reflectors. Because reflective surfaces have been eliminated, the losses associated with same have also been eliminated. Additionally, because the light of the present invention weighs less than lights using multiple reflectors, the supports therefore need not carry as much weight. Even though the light of the present invention eliminates the use of reflectors, the light of the present invention nonetheless provides a uniform, large diameter, source of light. The large diameter of the light of the present invention aids in the elimination of shadows. These and other advantages and benefits of the present invention will become apparent from the description of a preferred embodiment hereinbelow.

BRIEF DESCRIPTION OF THE DRAWINGS

In order that the present invention may be clearly understood and readily practiced, preferred embodiments will now be described, by way of example only, with reference to the accompanying figures wherein.

DESCRIPTION OF A PREFERRED EMBODIMENT

Figure 1:
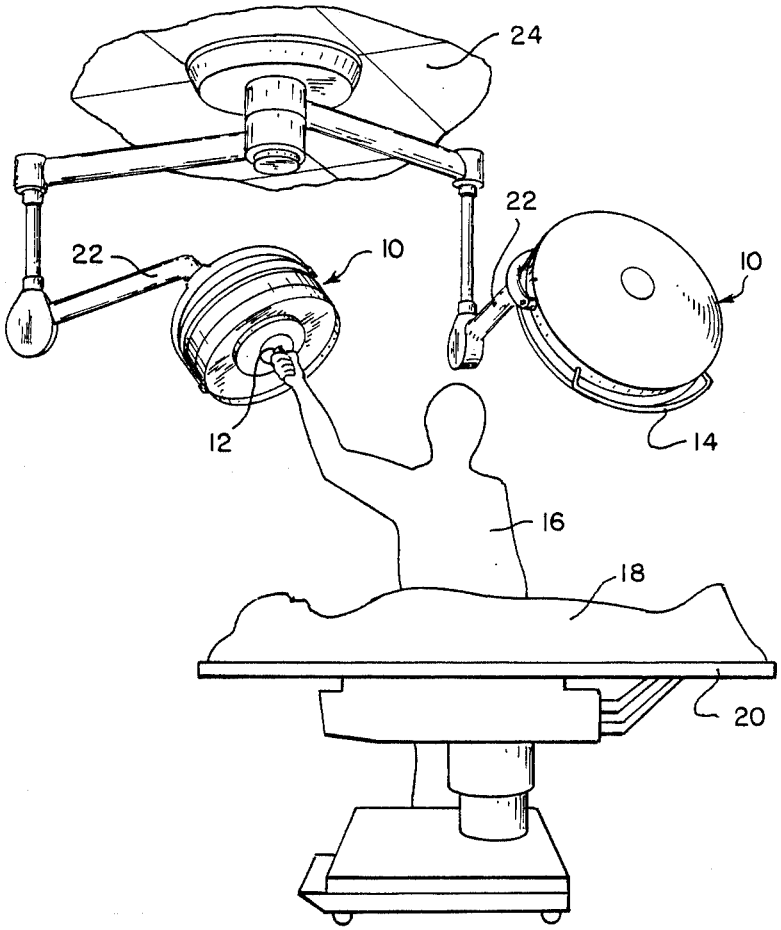
FIG. 1 illustrates a surgical setting wherein two spinning lights constructed according to the teachings of the present invention are employed.

FIG. 1 illustrates a surgical setting wherein two spinning lights 10 constructed according to the teachings of the present invention are used. Although the spinning lights 10 of the present invention are illustrated in FIG. 1 as surgical lights, the spinning lights 10 of the present invention may be used in numerous other applications and are not intended to be limited to surgical applications. The surgical spinning lights 10 have handles 12 and 14 which enable a surgeon 16 to focus the lights 10 onto a patient 18 positioned upon a surgical table 20. The spinning lights 10 are supported by an articulated support structure 22 suspended from a ceiling 24. Power for the lights 10 is delivered through wires (not shown in FIG. 1) positioned within the articulated support structure 22 in a known manner. The articulated support structure 22 does not form a part of the present invention but has been illustrated merely for purposes of completeness. Any type of appropriate support structure, whether suspended from the ceiling, wall, or floor, may be used in conjunction with the spinning lights 10 of the present invention.

Figure 2:
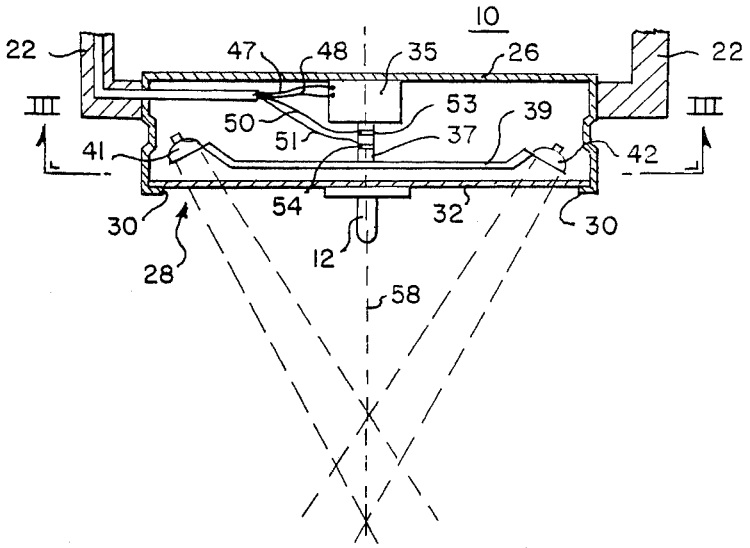
FIG. 2 is a view, partially in cross-section, of one of the spinning lights illustrated in FIG. 1.

In FIG. 2, a view, partially in cross-section, of one of the spinning lights 10 is illustrated. The spinning light 10 is constructed of a substantially cylindrical outer casing 26. The cylindrical casing 26 has an open end 28 at one end thereof. The open end 28 has a lip 30 for carrying lens 32 of any known type. The lens 32 may carry the handle 12.

Figure 3:
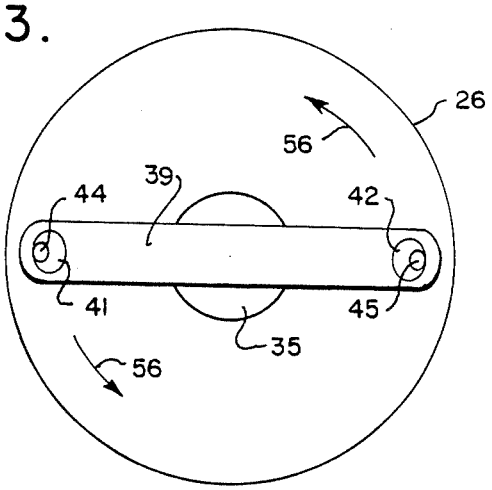
FIG. 3 is a view taken along the line III—III in FIG. 2 of the spinning light illustrated in FIG. 2.

The substantially cylindrical casing 26 carries a motor 35. The motor 35 has a shaft 37 connected to a rotatable arm 39. A pair of lamps 41 and 42, which may be rim lamps, are mounted on opposite ends of the rotatable arm 39 which performs the function of a rotatable support. Each of the rim lamps 41 and 42 includes a lamp bulb 44 and 45, respectively, which are seen in FIG. 3. In FIG. 3, which is a view looking into the open end 28 of the cylindrical casing 26, the electric motor 35, rotatable arm 39, and rim lamps 41 and 42 can be seen. The rim lamps 41 and 42 each provide a small diameter lighting pattern. The rim lamps 41 and 42 are carried by the rotatable arm 39 at an angle relative thereto such that the respective small lighting patterns of the rim lamps 41 and 42 eventually intersect as shown in FIG. 2.

The motor 35 is connected to a source of power through conductors 47 and 48 carried within the articulated support structure 22. Power is provided to the rim lamps 41 and 42 through a pair of conductors 50 and 51 operating in conjunction with a pair of slip-rings 53 and 54, respectively, in a known manner.

In operation, the electric motor 35 causes the rotatable arm 39 to rotate in the direction of the arrows 56 in FIG. 3. As the rim lamps 41 and 42 rotate, their small lighting patterns illuminate various portions of the patient 18. By rotating the rim lamps 41 and 42 at a speed greater than the retention time of the human eye, e.g. at a frequency of approximately 60 cycles per second, the eyes of the surgeon 16 perceive the entire area illuminated by the sweeping of the small lighting patterns across the patient 18 as being continuously illuminated. In this manner, a uniform, large diameter, source of light is provided from two small light sources each providing a small diameter lighting pattern. The uniform, large diameter, source of light is provided without the need for expensive, heavy reflectors. This represents a substantial advance over the art.

Figure 4:
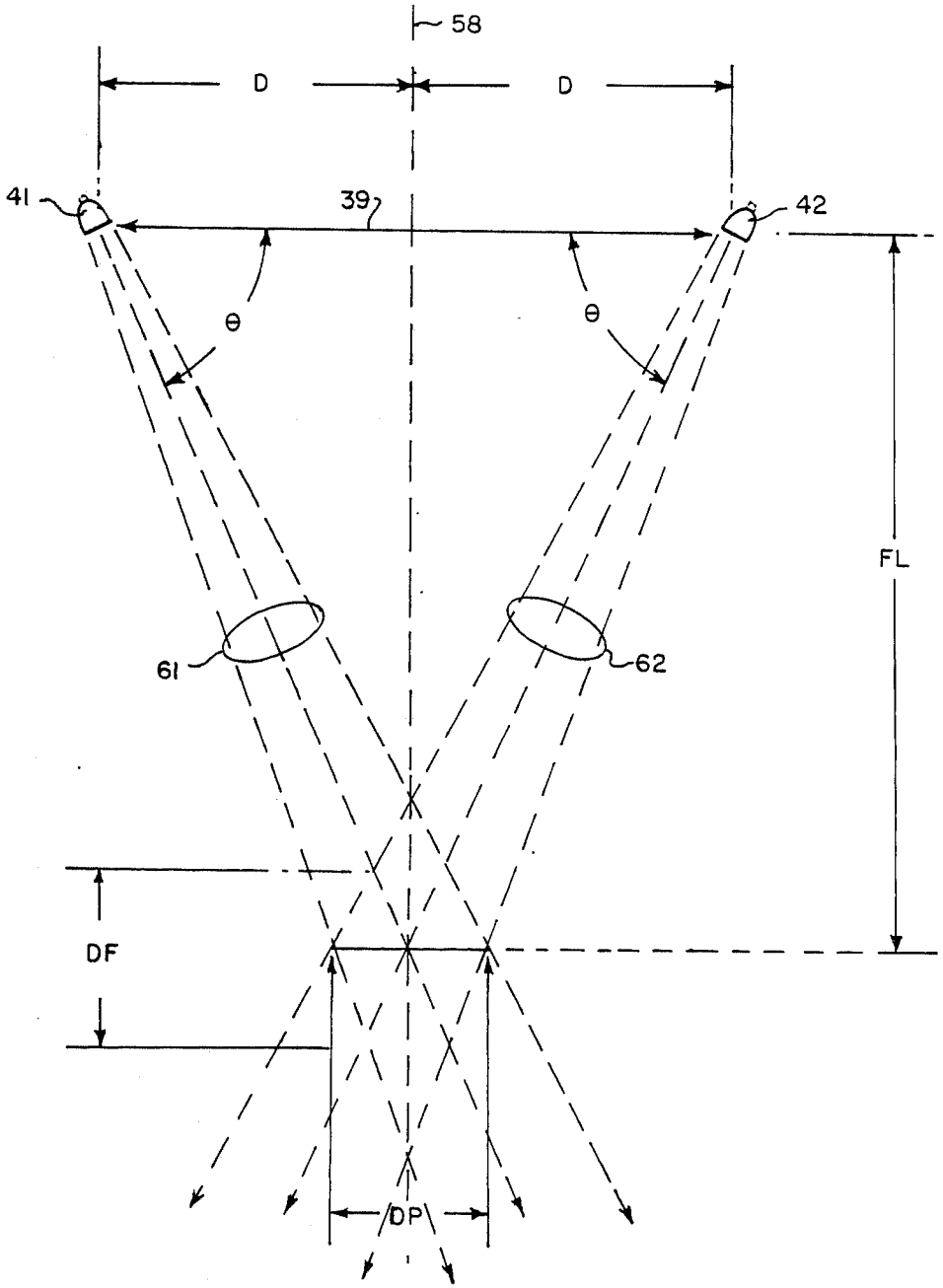
FIG. 4 illustrates the light rays eminating from, and pattern of light produced by, the spinning light of the present invention.

Turning now to FIG. 4, the rim lamps 41 and 42 of the spinning light 10 are illustrated in order to demonstrate how the spinning light 10 of the present invention may be constructed. Those of ordinary skill in the art will recognize that in designing a light, consideration must be given to the diameter DP of the lighting pattern as well as the depth of field DF. Assuming that a lighting pattern having a desired diameter DP and a desired depth of field DF is to be designed, the parameters which may be varied are the focal length FL, the distance D between the rim lamps 41 and 42 and the axis of rotation 58 of the spinning light 10, the angle $\theta$ between the light sources 41 and 42 and the arm 39, and the lighting patterns 61 and 62 produced by the rim lamps 41 and 42, respectively.

For example, assume that a lighting pattern is to have a diameter DP of approximately eight inches and a depth of field DF of approximately nine inches. Assume further that the focal length FL is dictated by the required application to be approximately thirty-eight inches. Under those circumstances, using two inch rim lamps for the lamps 41 and 42 and displacing the rim lamps 41 and 42 a distance D of seventeen inches from the axis of rotation 58 results in an angle $\theta$ between the rim lamps 41 and 42 and the arm 39 of approximately sixty-six degrees. Those of ordinary skill in the art will recognize that other pattern diameters DP and other depths of fields DF can be produced by appropriately adjusting the focal length FL, the displacement D of the rim lamps 41 and 42 from the axis of rotation 58, the angle between the rim lamps 41 and 42 and the rotatable arm 39, and the lighting pattern 61 and 62 produced by the lamps 41 and 42, according to known trigonometic functions or by laying out a scale representation on a drafing table.

Figure 5:
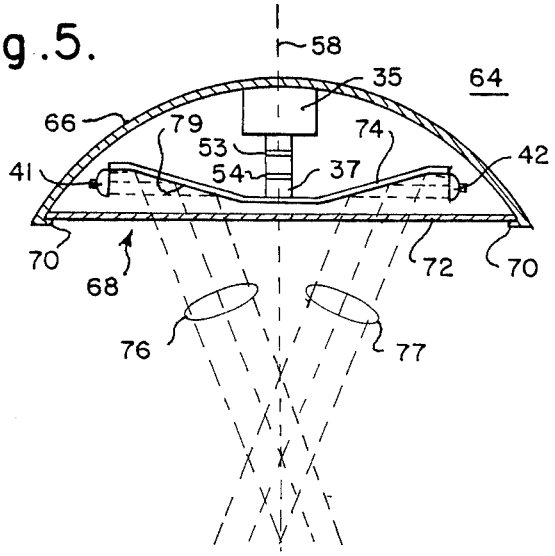
FIG. 5 illustrates another embodiment for a spinning light constructed according to the teachings of the present invention.

In FIG. 5, another embodiment for a spinning light 64 constructed according to teachings of the present invention is illustrated. The spinning light 64 is comprised of a substantially hemispherical casing 66 having an open end 68. The open end 68 carries a lip 70 for retaining a lens 72.

The motor 35 is carried by the casing 66 of the spinning light 64. The shaft 37 of the electric motor 35 carries slip rings 53 and 54. The shaft 37 is connected to a rotatable arm 74 which carries the rim lamps 41 and 42. The rotatable arm 74 has a mirrored or reflective under surface 79. The rotatable arm 74 carries the rim lamps 41 and 42 at an angle such that light from the rim lamps is reflected off the reflective surface 79 of the rotatable arm 74. In this embodiment, the light patterns 76 and 77 created by the combination of the first rim lamp 41 and the rotatable arm 74 and the second rim lamp 42 and the rotatable arm 74, respectively, are bars or stripes of light when the rotatable arm 74 is not rotating. It is anticipated that because of the bar shape of the light patterns 76 and 77 an enhanced depth of field will be provided by the spinning light 64 illustrated in FIG. 5.

While the present invention has been described in connection with exemplary embodiments thereof, it will be understood that many modifications and variations will be readily apparent to those of ordinary skill in the art. This disclosure and the following claims are indentified to cover all such modifications and variations.

What is claimed is:

1. A light for providing a large diameter lighting pattern, comprising:

a rotatable arm having a reflective surface;

means for rotating said arm at a frequency greater than the retention time of the human eye; and first and second sources of light each providing a small lighting pattern, said sources being carried on opposite ends of said rotatable arm such that upon rotation thereof a large diameter lighting pattern is created, said sources being carried by said arm at an angle that permits light from said light sources to be reflected from said reflective surface of said arm.

2. The light of claim 1 wherein said reflective surface of said arm includes a mirrored surface.

3. The light of claim 1 additionally comprising slip-rings carried by said rotatable support for connecting said sources of light to a source of power.

4. The light of claim 1 wherein said means for rotating includes an electric motor.

5. The light of claim 1 additionally comprising an outer casing having a substantially cylindrical shape for carrying said rotatable arm.

6. The light of claim 1 additionally comprising an outer casing having a substantially hemispherical shape for carrying said rotatable arm.

7. The light of claim 1 additionally comprising an articulated means for supporting said light.

* * * * *

UNITED STATES PATENT AND TRADEMARK OFFICE

CERTIFICATE OF CORRECTION

PATENT NO. : 4,745,526

DATED : May 17, 1988

INVENTOR(S) : Joseph T. Sestak

It is certified that error appears in the above-identified patent and that said Letters Patent is hereby corrected as shown below:

Title page under Abstract, line 1, delete "larger" and substitute therefor --large--.

Col. 4, line 8, delete "drafing" and substitute therefor --drafting--.

Signed and Sealed this

Twenty-fifth Day of October, 1988

*Attest:*

DONALD J. QUIGG

*Attesting Officer*

*Commissioner of Patents and Trademarks*